US010060005B2

(12) United States Patent
Hikida et al.

(10) Patent No.: US 10,060,005 B2
(45) Date of Patent: Aug. 28, 2018

(54) HIGH-STRENGTH HOT-FORMED STEEL SHEET MEMBER

(71) Applicant: NIPPON STEEL & SUMITOMO METAL CORPORATION, Tokyo (JP)

(72) Inventors: Kazuo Hikida, Tokyo (JP); Shinichiro Tabata, Tokyo (JP); Nobusato Kojima, Tokyo (JP); Takahiro Moriki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 188 days.

(21) Appl. No.: 15/128,559

(22) PCT Filed: Mar. 26, 2015

(86) PCT No.: PCT/JP2015/059491

§ 371 (c)(1),
(2) Date: Sep. 23, 2016

(87) PCT Pub. No.: WO2015/147216

PCT Pub. Date: Oct. 1, 2015

(65) Prior Publication Data

US 2017/0096724 A1 Apr. 6, 2017

(30) Foreign Application Priority Data

Mar. 26, 2014 (JP) ..... 2014-063941
Mar. 26, 2014 (JP) ..... 2014-063944

(51) Int. Cl.
*C21D 9/00* (2006.01)
*C22C 38/04* (2006.01)
(Continued)

(52) U.S. Cl.
CPC ..... *C21D 9/46* (2013.01); *B22D 11/001* (2013.01); *C21D 8/0226* (2013.01);
(Continued)

(58) Field of Classification Search
CPC .. C21D 9/00; C21D 9/46; C22C 38/00; C22C 38/04; C22C 38/06; C22C 38/12; C22C 38/14; C22C 38/28
See application file for complete search history.

(56) References Cited

U.S. PATENT DOCUMENTS

2005/0230012 A1* 10/2005 Usami ..... C21D 8/0205 148/648
2011/0091348 A1 4/2011 Hatano et al.
(Continued)

FOREIGN PATENT DOCUMENTS

CN 102046826 A 5/2011
EP 2 581 465 A1 4/2013
(Continued)

OTHER PUBLICATIONS

International Search Report for PCT/JP2015/059491 dated Jun. 23, 2015.
(Continued)

*Primary Examiner* — Mark Kopec
(74) *Attorney, Agent, or Firm* — Birch, Stewart, Kolasch & Birch, LLP

(57) ABSTRACT

A high-strength hot-formed steel sheet member exhibiting both a consistent hardness and delayed-fracture resistance, and is characterized in that: the high-strength hot-formed steel sheet member has a prescribed chemical composition; the degree of Mn segregation α (=[maximum Mn concentration (mass %) at the sheet center in the thickness direction]/[average Mn concentration (mass %) at a depth of ¼ of the total thickness of the sheet from the surface]) is less than or equal to 1.6; the steel purity value as defined in JIS G 0555 (2003) is less than or equal to 0.08%; the average grain size for prior γ grains is less than or equal to 10 μm;
(Continued)

and the number density of the residual carbides is less than or equal to $4\times10^3$ particles/$mm^2$.

7 Claims, 1 Drawing Sheet

(51) Int. Cl.

| | |
|---|---|
| ***C22C 38/28*** | (2006.01) |
| ***C21D 9/46*** | (2006.01) |
| ***C25D 3/22*** | (2006.01) |
| ***C23C 2/06*** | (2006.01) |
| ***B22D 11/00*** | (2006.01) |
| ***C22C 38/54*** | (2006.01) |
| ***C22C 38/50*** | (2006.01) |
| ***C22C 38/48*** | (2006.01) |
| ***C22C 38/32*** | (2006.01) |
| ***C22C 38/26*** | (2006.01) |
| ***C22C 38/24*** | (2006.01) |
| ***C22C 38/22*** | (2006.01) |
| ***C22C 38/20*** | (2006.01) |
| ***C22C 38/06*** | (2006.01) |
| ***C22C 38/02*** | (2006.01) |
| ***C22C 38/00*** | (2006.01) |
| ***C21D 8/02*** | (2006.01) |
| ***C23C 2/40*** | (2006.01) |

(52) U.S. Cl.
CPC ..... *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/48* (2013.01); *C22C 38/50* (2013.01); *C22C 38/54* (2013.01); *C23C 2/06* (2013.01); *C23C 2/40* (2013.01); *C25D 3/22* (2013.01)

(56) References Cited

U.S. PATENT DOCUMENTS

| | | | | |
|---|---|---|---|---|
| 2015/0225821 | A1 | 8/2015 | Hikida et al. | |
| 2017/0073792 | A1* | 3/2017 | Hikida | C21D 9/46 |
| 2018/0135155 | A1* | 5/2018 | Suwa | C22C 38/58 |

FOREIGN PATENT DOCUMENTS

| | | | | |
|---|---|---|---|---|
| JP | 2002-102980 | A | | 4/2002 |
| JP | 2006-213959 | A | | 8/2006 |
| JP | 2007-182608 | A | | 7/2007 |
| JP | 2012-180594 | A | | 7/2007 |
| JP | 2007-314817 | A | | 12/2007 |
| JP | 2007314817 | A | * | 12/2007 |
| JP | 2012-237048 | A | | 12/2012 |
| TW | 201420776 | A | | 6/2014 |

OTHER PUBLICATIONS

Written Opinion of the International Searching Authority for PCT/JP2015/059491 (PCT/ISA/237) dated Jun. 23, 2015.

* cited by examiner

HIGH-STRENGTH HOT-FORMED STEEL SHEET MEMBER

TECHNICAL FIELD

The present invention relates to a high strength hot formed steel sheet member, more particularly relates to a high strength hot formed steel sheet member excellent in delayed fracture resistance.

BACKGROUND ART

In the field of steel sheets for automobile use, to achieve both lighter weight for improved fuel efficiency and improvement of the impact resistance, there has been growing use of high strength steel sheet having a high tensile strength. However, along with higher strength, the press formability of steel sheet falls, so production of complicated shapes of products has become difficult.

As a result, for example, along with the higher strength of steel sheet, the problem of the ductility falling and fracture occurring at portions with a high working degree and the problem of the springback and wall camber becoming greater and therefore the dimensional precision deteriorating arise. Therefore, it has not been easy to press-form steel sheet having a high strength, in particular 780 MPa or more tensile strength, into a product having a complicated shape.

Therefore, in recent years, as disclosed in PLT 1, as art for press-forming high strength steel sheet and other such hard-to-shape materials, hot stamping has been employed. "Hot stamping" is a hot forming technique which heats a material used for forming and then forms it. With this technique, the sheet is hardened simultaneously with the forming process, so at the time of the forming process, the steel sheet is soft and has good shapeability while after the forming process, the shaped member can be given a strength higher than steel sheet for cold forming use.

PLT 2 discloses a steel member having a 980 MPa tensile strength.

PLT 3 discloses to lower the cleanliness and segregation ratios of P and S to obtain a hot pressed steel sheet member excellent in strength and toughness.

CITATION LIST

Patent Literature

PLT 1. Japanese Patent Publication No. 2002-102980A
PLT 2. Japanese Patent Publication No. 2006-213959A
PLT 3. Japanese Patent Publication No. 2007-314817A

SUMMARY OF INVENTION

Technical Problem

The metal material of PLT 1 is insufficient in hardenability at the time of hot pressing, so there is the problem of inferior stability of hardness as a result. PLTs 2 and 3 disclose steel sheets excellent in tensile strength and toughness, so room remains for improvement in terms of the delayed fracture resistance.

The present invention was made for solving the above problem and has as its object the provision of high strength hot formed steel sheet member realizing both hardness stability and delayed fracture resistance. Note that, a hot formed steel sheet member is in many cases not a flat sheet, but a shaped member. In the present invention, this will be referred to as a "hot formed steel sheet member" including also the case of a shaped member.

Solution to Problem

The inventors engaged in intensive studies on the relationship of the chemical composition and metal structure for satisfying both hardness stability and delayed fracture resistance. As a result, they obtained the following discoveries.

(a) By refining the prior γ-grains, it is possible to improve the fracture resistance and suppress delayed fracture. To refine the prior γ-grains, it is necessary to include a prescribed amount of Nb.

(b) If the steel contains a large amount of inclusions, hydrogen is trapped at the interfaces of the inclusions. This easily becomes the starting points of delayed fracture. For this reason, in particular in the case of such a hot formed steel sheet member having a 1.7 GPa or more tensile strength, it is necessary to lower the value of the cleanliness of the steel prescribed in JIS G 0555 (2003).

(c) By being able to reduce the center segregation of Mn, it becomes possible to suppress the concentration of MnS acting as the starting points of delayed fracture and suppress the formation of hard structures at the center part of sheet thickness. To reduce the center segregation of Mn, it is necessary to limit the Mn content to a certain value or less and to lower the segregation ratio of Mn.

(d) If limiting the Mn content, the hardenability falls and the hardness stability deteriorates, so it is necessary to supplement the hardenability by including mainly Cr and B.

(e) If the number density of the residual carbides is high, they become hydrogen trapping sites in the same way as inclusions and become starting points for delayed fracture. For this reason, it is necessary to lower the number density.

(f) By hot forming steel sheet adjusted in chemical composition, reduced in inclusions, and reduced in center segregation of Mn in the above way while reducing the residual carbide density, it is possible to obtain a steel sheet member excellent in hardness stability and delayed fracture resistance.

The present invention was made based on the above discoveries and has as its gist the following.

(1) A high strength hot formed steel sheet member having: a chemical composition comprising, by mass %, C: 0.25 to 0.40%, Si: 0.005 to 0.14%, Mn: 1.50% or less, P: 0.02% or less, S: 0.005% or less, sol. Al: 0.0002 to 1.0%, N: 0.01% or less, Cr: 0.25 to 3.00%, Ti: 0.01 to 0.05%, Nb: 0.01 to 0.50%, and B: 0.001 to 0.01%, a balance of Fe and unavoidable impurities, a total of content of Mn and content of Cr of 1.5 to 3.5%, an Mn segregation ratio α represented by the following formula (i) of 1.6 or less, a value of cleanliness of steel prescribed by JIS G 0555 (2003) of 0.08% or less, an average grain size of prior γ-grains of 10 μm or less, and a number density of residual carbides present of $4\times10^3/mm^2$ or less:

$$\alpha=[\text{Maximum Mn concentration at center part in sheet thickness(mass \%)}]/[\text{Average Mn concentration at position of ¼ sheet thickness depth from surface(mass \%)}] \quad (i)$$

(2) The high strength hot formed steel sheet member according to (1) wherein the chemical composition further includes, by mass %, one or more elements selected from Ni: 0 to 3.0%, Cu: 0 to 1.0%, Mo: 0 to 2.0%, V: 0 to 0.1%, and Ca: 0 to 0.01%.

(3) The high strength hot formed steel sheet member according to (1) or (2) having a plating layer at the surface of the steel sheet.

(4) The high strength hot formed steel sheet member according to any one of (1) to (3) wherein the steel sheet member has a 1.7 GPa or more tensile strength.

Advantageous Effects of Invention

According to the present invention, it is possible to obtain a high strength hot formed steel sheet member having a 1.7 GPa or more tensile strength and able to realize both hardness stability and delayed fracture resistance. The high strength hot formed steel sheet member of the present invention is particularly suitable for use as an impact resistant part of an automobile.

DESCRIPTION OF EMBODIMENT

Figure 1:
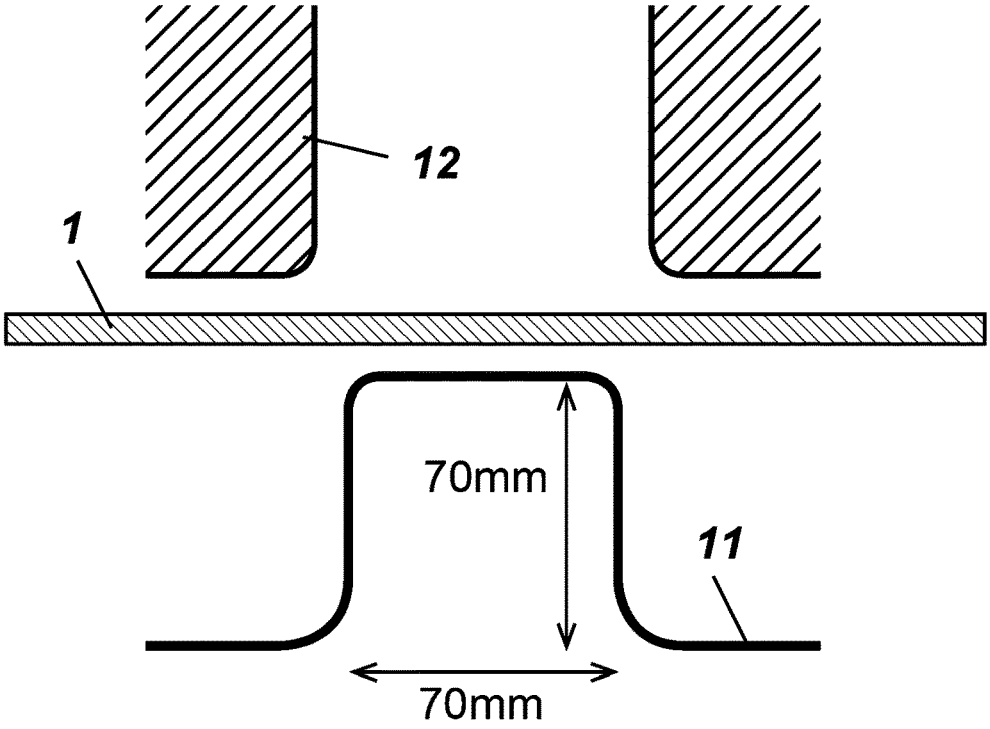
FIG. 1 is a schematic view showing the shape of a die set in forming a hat shape in an example.

Below, the requirements of the present invention will be explained in detail.

(A) Chemical Composition

The reasons for limitation of the elements are as follows. Note that in the following explanation, the "%" in the content means "mass %".

C: 0.25 to 0.40%

C is an important element for raising the hardenability of steel and securing the strength after hardening. Further, C is an austenite-forming element, so has the action of suppressing the strain-induced ferrite transformation at the time of high strain formation. For this reason, obtaining a stable hardness distribution in the hot formed steel sheet member is facilitated. If the C content is less than 0.25%, it becomes difficult to secure a 1100 MPa or more tensile strength after hardening and to obtain the above effect. Therefore, the C content is made 0.25% or more. On the other hand, if the C content exceeds 0.40%, the strength after hardening excessively rises and the toughness deteriorates. Therefore, the C content is made 0.40% or less. The C content is preferably 0.37% or less, more preferably 0.35% or less.

Si: 0.005 to 0.14%

Si is an element having the action of suppressing the formation of scale at the time of high temperature heating at the time of hot forming. If the Si content is less than 0.005%, the above effect can no longer be sufficiently obtained. Therefore, the Si content is made 0.005% or more. On the other hand, if the Si content is over 0.14%, the heating temperature required for austenite transformation at the time of hot forming becomes remarkably high. For this reason, a rise in the cost required for heat treatment is invited and insufficient heating causes the hardening to become insufficient.

Further, Si is a ferrite-forming element, so if the Si content is too high, strain-induced ferrite transformation easily occurs at the time of high strain formation, so at the hot formed steel sheet member, a local drop in hardness is caused and a stable hardness distribution can no longer be obtained. Furthermore, if including a large amount of Si, sometimes the wettability drops when performing hot dip coating and gives rise to nonplating defects. Therefore, the Si content is made 0.14% or less. An Si content of 0.01% or more is preferable, while 0.03% or more is more preferable. Further, the Si content is preferably 0.12% or less.

Mn: 1.50% or Less

Mn is an element useful for raising the hardenability of steel sheet and stably securing the strength after hot forming. However, in the present invention, to reduce the center segregation of Mn, the content has to be limited. If the Mn content is over 1.50%, the segregation of Mn causes the toughness to deteriorate. Therefore, the Mn content is made 1.50% or less. An Mn content of 0.5% or more is preferable, and 1.3% or less is preferable.

P: 0.02% or Less

P is an element contained as an impurity, but has the action of raising the hardenability of the steel and furthermore stably securing the strength of the steel after hardening, so may be proactively included. However, if the P content exceeds 0.02%, the toughness remarkably deteriorates. Therefore, the P content is made 0.02% or less. A P content of 0.01% or less is preferable. A lower limit of the P content does not have to be particularly set. However, excessive reduction of the P content causes the cost to remarkably rise, so the P content is preferably 0.0002% or more.

S: 0.005% or Less

S is an element contained as an impurity, but forms MnS and degrades the delayed fracture property. If the S content exceeds 0.005%, the toughness and delayed fracture property remarkably deteriorate. Therefore, the S content is made 0.005% or less. A lower limit of the S content does not have to be particularly set. However, excessive reduction of the S content causes the cost to remarkably rise, so the S content is preferably 0.0002% or more.

Sol. Al: 0.0002 to 1.0%

Al is an element having the action of deoxidizing the molten steel and making the steel sounder. If the sol. Al content is less than 0.0002%, the deoxidation is not sufficient. Furthermore, Al is also an element which has the action of raising the hardenability of the steel sheet and stably securing the strength after hardening, so may be proactively included. Therefore, the sol. Al content is made 0.0002% or more. However, even if over 1.0% is included, the effect obtained by that action is small and the cost increases. For this reason, the Al content is made 1.0% or less. An Al content of 0.01% or more is preferable, an 0.2% or less is preferable.

N: 0.01% or Less

N is an element contained as an impurity and degrades the toughness. If the N content exceeds 0.01%, coarse nitrides are formed in the steel and the local deformation ability and toughness are remarkably degraded. Therefore, the N content is made 0.01% or less. An N content of 0.008% or less is preferable. A lower limit of the N content does not have to be particularly set. However, excessive reduction of the N content causes the cost to remarkably rise, so the N content is preferably 0.0002% or more. 0.0008% or more is more preferable.

Cr: 0.25 to 3.00%

Cr is an element having the action of raising the hardenability of the steel. For this reason, in the present invention, which limits the Mn content to 1.5% or less, it is a particularly important element. Further, Cr is an austenite-forming element and has the action of suppressing the strain-induced ferrite transformation at the time of high strain formation. For this reason, by including Cr, it becomes easy to obtain a stable hardness distribution in the hot formed steel sheet member.

If the Cr content is less than 0.25%, the above effect cannot be sufficiently obtained. Therefore, the Cr content is made 0.25% or more. On the other hand, if the Cr content exceeds 3.00%, the Cr concentrates at the carbides in the steel to thereby delay the dissolution of carbides in the heating process when supplied for hot forming and to lower the hardenability. Therefore, the Cr content is made 3.00% or less. A Cr content of 0.3% or more is preferable, while 0.4% or more is more preferable. Further, a Cr content of 2.5% or less is preferable.

Ti: 0.01 to 0.05%

Ti is an element having the action of suppressing the recrystallization of the austenite grains when heating a hot-forming use steel sheet to the $Ac_3$ point or more and supplying it for hot forming. Furthermore, it has the action of forming fine carbides and suppressing the growth of austenite grains to thereby obtain fine grains. For this reason, it has the action of greatly improving the toughness of the hot formed steel sheet member. Further, Ti preferentially bonds with the N in the steel, so suppresses the consumption of B due to the precipitation of BN and as a result has the action of raising the hardenability due to B.

Therefore, the Ti content is made 0.01% or more. However, if over 0.05% is included, the amount of precipitation of TiC increases, C is consumed, and the strength after hardening falls. For this reason, the Ti content is made 0.05% or less. A Ti content of 0.015% or more is preferable, and 0.04% or less is preferable.

Nb: 0.01 to 0.50%

Nb, like Ti, is an element having the action of suppressing the recrystallization when heating the hot-forming use steel sheet to the $Ac_3$ point or more for hot forming and, furthermore, forming fine carbides to suppress grain growth and make the austenite grains finer. For this reason, it has the action of greatly improving the toughness of the hot formed steel sheet member.

Therefore, the Nb content is made 0.01% or more. However, if over 0.50% is included, the amount of precipitation of NbC increases, C is consumed, and the strength after hardening falls. For this reason, the Nb content is made 0.50% or less. A Nb content of 0.015% or more is preferable, and 0.45% or less is preferable.

B: 0.001 to 0.01%

B is an element having the action of enabling raising of the hardenability of steel and stable securing of the strength after hardening. For this reason, in the present invention, which limits the Mn content to 1.5% or less, it is a particularly important element. If the B content is less than 0.001%, it is not possible to sufficiently obtain the above effect. Therefore, the B content is made 0.001% or more. On the other hand, if the B content exceeds 0.01%, the above effect becomes saturated and furthermore deterioration of the toughness of the hardened part is invited. Therefore, the B content is made 0.01% or less. A B content of 0.005% or less is preferable.

Mn+Cr: 1.5 to 3.5%

As explained above, Mn and Cr are elements which raise the hardenability of the steel sheet and stably secure the strength after hardening, so are extremely effective. However, if the total content of Mn and Cr is less than 1.5%, the effect is not sufficient, while if over 3.5%, the effect becomes saturated and conversely securing stable strength becomes difficult. Therefore, the total content of Mn and Cr is made 1.5 to 3.5%. A total content of Mn and Cr of 2.0% or more is preferable, and 3.0% or less is preferable.

The high strength hot formed steel sheet member of the present invention has a chemical composition comprised of the elements from the above C to B and of a balance of Fe and impurities.

Here, "impurities" mean components mixed in at the time of industrial production of steel sheet due to the ore, scraps, and other raw materials and various factors in the production process and allowed in a range not detrimentally affecting the present invention.

The high strength hot formed steel sheet member of the present invention may contain, in addition to the above elements, one or more elements selected from the amounts of Ni, Cu, Mo, V, and Ca shown below.

Ni: 0 to 3.0%

Ni is an element effective for increasing the hardenability of steel sheet and stably securing strength after hardening, so may be included in accordance with need. However, even if over 3.0% of Ni is included, the effect is small and the cost increases. For this reason, if including Ni, the content is made 3.0% or less. An Ni content of 1.5% or less is preferable. If desiring to obtain the above effect, an Ni content of 0.01% or more is preferable, while 0.05% or more is more preferable.

Cu: 0 to 1.0%

Cu is an element effective for increasing the hardenability of steel sheet and stably securing strength after hardening, so may be included in accordance with need. However, if over 1.0% of Cu is included, the effect is small and the cost increases. For this reason, if including Cu, the content is made 1.0% or less. A Cu content of 0.5% or less is preferable. If desiring to obtain the above effect, a Cu content of 0.01% or more is preferable, while 0.03% or more is more preferable.

Mo: 0 to 2.0%

Mo is an element having the action of forming fine carbides and suppressing the growth of grains when heating the hot forming-use steel sheet to the $Ac_3$ point or more for hot forming. For this reason, it has the action of greatly improving the toughness of the hot formed steel sheet member. For this reason, Mo may be included in accordance with need.

However, if the Mo content is over 2.0%, the effect becomes saturated and the cost increases. Therefore, when including Mo, the content is made 2.0% or less. An Mo content of 1.5% or less is preferable, while 1.0% or less is more preferable. To obtain the above effect, an Mo content of 0.01% or more is preferable, while 0.04% or more is more preferable.

V: 0 to 0.1%

V is an element effective for increasing the hardenability of steel sheet and stably securing strength after hardening, so may be included in accordance with need.

However, if over 1.0% of V is included, the effect is small and the cost increases. For this reason, if including V, the content is made 0.1% or less. A V content of 0.05% or less is preferable. If desiring to obtain the above effect, a V content of 0.001% or more is preferable, while 0.005% or more is more preferable.

Ca: 0 to 0.01%

Ca is an element having the effect of refining the inclusions in the steel and improving the toughness after hardening, so may be included in accordance with need. However, if the Ca content exceeds 0.01%, the effect becomes saturated and the cost increases. Therefore, if including Ca, the content is made 0.01% or less. A Ca content of 0.005% or less is preferable. If desiring to obtain the above effect, a Ca content of 0.001% or more is preferable, while 0.002% or more is more preferable.

(B) Microstructure

Mn segregation ratio α: 1.6 or less $$\alpha = [\text{Maximum Mn concentration at center part of sheet thickness(mass \%)}]/[\text{Average Mn concentration at position of } 1/4 \text{ sheet thickness depth from surface(mass \%)}] \quad \text{(i)}$$

At the center part of the cross-section of sheet thickness of the steel sheet, the occurrence of center segregation would cause Mn to concentrate. Therefore, MnS would concentrate at the center as inclusions, hard martensite would easily form, a difference would arise in hardness with the surroundings, and the toughness would deteriorate.

In particular, if the value of the segregation ratio $\alpha$ of Mn represented by the above formula (i) exceeds 1.6, the toughness would remarkably deteriorate. Therefore, to improve the toughness, the value of $\alpha$ of the hot-forming use steel sheet has to be made 1.6 or less. To further improve the toughness, the value of $\alpha$ is preferably made 1.2 or less.

Note that, the value of $\alpha$ does not greatly change due to hot forming, so if making the value of $\alpha$ of the hot forming-use steel sheet the above range, it is possible to make the value of $\alpha$ of the hot formed steel sheet member 1.6 or less.

The maximum Mn concentration at the center part of sheet thickness is found by the following method. An electron probe microanalyzer (EPMA) was used for line analysis at the center part of sheet thickness of the steel sheet. From the results of analysis, three measurement values were selected in the order of the highest down and the average value was calculated. Further, the average Mn concentration at a position of ¼ sheet thickness depth from the surface was found by the following method. Using the same EPMA, 10 locations at positions of ¼ steel sheet depth were analyzed. The average value was calculated.

The segregation of Mn in the steel sheet is mainly controlled by the composition of the steel sheet, in particular the contents of impurities, and the conditions of the continuous casting. It does not substantially change before and after hot rolling and hot forming. Therefore, if the state of segregation of the hot forming-use steel sheet satisfies the requirements of the present invention, the inclusions and segregated state of the hot formed steel sheet member produced by hot forming after that similarly satisfy the requirements of the present invention.

Cleanliness: 0.08% or Less

If the steel sheet member has large amounts of the A-based, B-based, and C-based inclusions described in JIS G 0555 (2003), the inclusions will easily become starting points for delayed fracture. If the inclusions increase, fracture propagation will easily occur, so the delayed fracture resistance will deteriorate and the toughness will deteriorate. In particular, in the case of a hot formed steel sheet member having a 1.7 GPa or more tensile strength, it is necessary to keep the proportion of the inclusions low.

If the value of the cleanliness of the steel prescribed in JIS G 0555 (2003) exceeds 0.08%, since the amount of the inclusions is large, it becomes difficult to secure a practically sufficient toughness. For this reason, the value of the cleanliness of the hot-forming use steel sheet is made 0.08% or less. To much further improve the toughness, the value of cleanliness is preferably made 0.04% or less. Note that, the value of the cleanliness of the steel was calculated by the percent area occupied by the above A-based, B-based, and C-based inclusions.

Note that, the hot forming does not cause the value of the cleanliness to greatly change, so by making the value of cleanliness of the hot-forming use steel sheet the above range enables the value of the cleanliness of the hot formed steel sheet member to also be made 0.08% or less.

In the present invention, the value of cleanliness of the hot formed steel sheet member is found by the following method. Test samples were cut out from five locations of the hot formed steel sheet member. At the positions of thickness ⅛t, ¼t, ½t, ¾t, and ⅞t of each test sample, the point count method was used to investigate the cleanliness. Further, the numerical value of the largest value of cleanliness at the sheet thicknesses (the lowest cleanliness) was made the value of cleanliness of that test sample.

Average Grain Size of Prior γ-Grains: 10 μm or Less

As explained above, if making the grain size of the prior γ-grains in the hot formed steel sheet member smaller, the delayed fracture resistance is improved. In steel sheet mainly comprised of martensite, if delayed fracture occurs, sometimes the sheet breaks at the prior γ-grain boundaries. However, by making the prior γ-grains finer, it is possible to keep the prior γ-grain boundaries from becoming starting points of cracking and delayed fracture from occurring and the delayed fracture resistance can be improved. If the average grain size of the prior γ-grains exceeds 10 μm, this effect cannot be exhibited. Therefore, the average grain size of the prior γ-grains in the hot formed steel sheet member is made 10 μm or less.

The average grain size of the prior γ-grains can be measured using the method prescribed in ISO643. That is, the number of crystal grains in a measurement field are counted. The area of the measurement field is divided by the number of crystal grains to find the average area of the crystal grains, then the crystal grain size is calculated by the circle equivalent diameter. At that time, a grain at the boundary of the field is counted as ½. The magnification is preferably adjusted to cover 200 or more crystal grains. Further, to improve the precision, measurement of a plurality of fields is preferable.

Residual Carbides: $4\times10^3/Mm^2$ or Less

In the case of hot forming, the redissolution of the carbides generally present in the steel enables sufficient hardenability to be secured. However, sometimes part of the carbides will not re-dissolve, but will remain. Residual carbides have the effect of suppressing γ-grain growth due to pinning when heating and holding the steel during hot forming. Therefore, during heating and holding, the presence of residual carbides is desirable. At the time of hot forming, the smaller the amount of these residual carbides, the more improved the hardenability and the more a high strength can be secured. Therefore, when finishing the heating and holding operation, it is preferable that the number density of residual carbides can be reduced.

If a large amount of residual carbides are present, not only is the hardenability after hot forming liable to fall, but also the residual carbides will sometimes deposit at the prior γ-grain boundaries and cause the grain boundaries to become brittle. In particular, if the number density of residual carbides exceeds $4\times10^3/mm^2$, the hardenability after hot forming is liable to deteriorate. Therefore, the number density of residual carbides in the hot formed steel sheet member is preferably made $4\times10^3/mm^2$ or less.

If a large amount of residual carbides are present, hydrogen is trapped at the carbide interfaces, so easily becomes starting points for hydrogen embrittlement cracking and the delayed fracture resistance also becomes poor.

(C) Plated/Coated Layer

The high strength hot formed steel sheet member of the present invention may have a plated or coated layer on its surface for the purpose of improving the corrosion resistance etc. The plated/coated layer may be an electroplated layer or a hot dip coated layer. For the electroplated layer, electrogalvanization, electro Zn—Ni alloy plating, electro Zn—Fe alloy plating, etc. may be mentioned. Further, as the hot dip coated layer, hot dip galvanization, hot dip galvannealing, hot dip aluminum coating, hot dip Zn—Al alloy coating, hot dip Zn—Al—Mg alloy coating, hot dip Zn—Al—Mg—Si alloy coating, etc. may be mentioned. The amount of plating/coating deposition is not particularly limited and may be adjusted within general ranges.

(D) Method of Production of Hot Forming-Use Steel Sheet

The hot forming-use steel sheet used for the high strength hot formed steel sheet member of the present invention can be produced by the method of production shown below.

Steel having each above chemical composition is smelted in a furnace, then is cast to prepare a slab. To make the cleanliness of the steel sheet 0.08% or less, when continuously casting the molten steel, preferably the heating temperature of the molten steel is made a temperature 5° C. or more higher than the liquidus temperature of the steel and the amount of casting of molten steel per unit time is kept to 6 t/min or less.

If the amount of casting per unit time of the molten steel at the time of continuous casting exceeds 6 t/min, the fluid motion of the molten steel in the mold is fast, so inclusions are easily trapped in the solidified shell and the inclusions in the slab increase. Further, if the molten steel heating temperature is less than a temperature 5° C. higher than the liquidus temperature, the viscosity of the molten steel becomes higher and it becomes difficult for inclusions to float up inside the continuous casting machine resulting in an increase in inclusions in the slab and easy deterioration of the cleanliness.

By casting while making the molten steel heating temperature from the liquidus temperature of the molten steel 5° C. or more and making the amount of casting of molten steel per unit time 6 t/min or less, it becomes difficult for inclusions to be brought into the slab. As a result, the amount of inclusions at the stage of preparing a slab can be effectively reduced and a steel sheet cleanliness of 0.08% or less can be easily achieved.

When continuously casting molten steel, the molten steel heating temperature is preferably made a temperature of 8° C. or more higher than the liquidus temperature, Further, the amount of casting of molten steel per unit time is preferably made 5 t/min or less. By making the molten steel heating temperature a temperature 8° C. or more higher than the liquidus temperature and making the amount of casting of molten steel per unit time 5 t/min or less, the cleanliness can be easily made 0.04% or less, so this is preferable.

Further, to suppress the concentration of MnS forming starting points of delayed fracture, it is preferable to reduce the center segregation of Mn by center segregation reduction treatment. As center segregation reduction treatment, the method of discharging the molten steel at which Mn has concentrated at the unsolidified layer before the slab becomes completely solidified can be mentioned.

Specifically, by electromagnetic stirring, reduction of the unsolidified layer, or other treatment, the molten steel at which Mn has concentrated before complete solidification can be discharged. Note that the electromagnetic stirring treatment can be performed by giving fluid motion to the unsolidified steel by 250 to 1000 Gauss, while the unsolidified layer rolling treatment can be performed by rolling the finally solidified part by a gradient of about 1 mm/m.

A slab obtained by the above method may if necessary be treated by soaking. By performing the soaking treatment, it is possible to make the precipitated Mn disperse and lower the segregation ratio. The preferable soaking temperature when performing soaking treatment is 1200 to 1300° C., while the soaking time is 20 to 50 h.

After that, the slab is hot rolled. The hot rolling conditions, from the viewpoint of enabling carbides to be more uniformly formed, are preferably made a hot rolling starting temperature of 1000 to 1300° C. in temperature range and a hot rolling end temperature of 850° C. or more. The coiling temperature is preferably high from the viewpoint of the processability, but if too high, scale formation will cause the yield to fall, so 500 to 650° C. is preferable. The hot rolled steel sheet obtained by the hot rolling may be treated to remove the scale by pickling etc.

In the present invention, to refine the prior γ-grain size after hot forming and lower the number density of the residual carbides, it is important to anneal the descaled hot rolled steel sheet to obtain hot rolled annealed steel sheet.

To refine the prior γ-grain size after hot forming, it is necessary to suppress the growth of the γ-grains by the carbides in the solution. However, to improve the hardenability and secure high strength in a hot formed steel sheet member, it is necessary to reduce the number density of the residual carbides.

To refine the prior γ-grain size in the hot formed steel sheet member and lower the number density of the residual carbides, the form of the carbides present in the steel sheet before hot forming and the degree of concentration of elements in the carbides become important. It is desirable that the carbides be finely dispersed, but in that case, the carbides dissolve more quickly, so the effect of grain growth cannot be expected. If making the Mn, Cr, and other elements concentrate in the carbides, it becomes harder for the carbides to form solid solutions. Therefore, the degree of concentration of elements in the carbides is preferably high.

The form of the carbides can be controlled by adjusting the annealing conditions after the hot rolling. Specifically, the annealing is performed at an annealing temperature of the Ac1 to the Ac1 point-100° C. for 5 h or less.

If making the coiling temperature after the hot rolling 550° C. or less, the carbides easily finely disperse. However, the degree of concentration of the elements in the carbides also falls, so annealing is performed to make the elements concentrate more.

If the coiling temperature is 550° C. or more, pearlite forms and elements increasingly concentrate in the carbides in the pearlite. In this case, annealing is performed to break up the pearlite and disperse the carbides.

As the steel sheet for high strength hot formed steel sheet member use in the present invention, it is possible to use hot rolled annealed steel sheet, cold rolled steel sheet, or cold rolled annealed steel sheet. The treatment process may be suitably selected in accordance with the demanded level of sheet thickness precision of the product. Note that, carbides are hard, so even if performing cold rolling, they are not changed in form. Their form before the cold rolling is maintained even after the cold rolling.

The cold rolling may be performed using an ordinary method. From the viewpoint of securing excellent flatness, the reduction rate at the cold rolling is preferably made 30% or more. On the other hand, to avoid the load from becoming excessive, the reduction rate at the cold rolling is preferably 80% or less.

When annealing the cold rolled steel sheet, it is preferable to degrease and otherwise treat it in advance. The annealing is performed for removing strain relief by cold rolling and is preferably performed by annealing at the Act point or less for 5 h or less, preferably 3 h or less.

(E) Method of Forming Plated/Coated Layer

The high strength hot formed steel sheet member of the present invention may have a plated/coated layer at its surface for the purpose of improving the corrosion resistance etc. The plated/coated layer is preferably formed at the steel sheet before hot forming.

When galvanizing the surface of the steel sheet, from the viewpoint of the productivity, hot dip galvanization is preferably performed on a continuous hot dip galvanization line. In that case, the steel sheet may be annealed before the plating treatment on the continuous hot dip galvanization line or the heating and holding temperature may be lowered and just coating treatment and not annealing performed.

Further, it is also possible to perform hot dip galvanization, then alloying heat treatment to obtain a hot dip galvannealed steel sheet. The galvanization may also be performed by electroplating. Note that galvanization need only be performed on part of the surface of a steel material, but in the case of steel sheet, it is generally performed on the entire surfaces of one or both surfaces.

(F) Method of Production of High Strength Hot Formed Steel Sheet Member

By hot forming the above hot-forming use steel sheet, it is possible to obtain a high strength hot formed steel sheet member.

The heating speed of the steel sheet at the time of hot forming is preferably 20° C./s or more from the viewpoint of suppressing grain growth. More preferable is 50° C./s or more. The heating temperature of the steel sheet is preferably over the $Ac_3$ point and not more than the $Ac_3$ point+150° C. If the heating temperature is the $Ac_3$ point or less, the structure will not become an austenite single phase before the hot forming and ferrite, pearlite, or bainite will remain in the steel sheet. As a result, after hot forming, sometimes the structure will not become a martensite single-phase structure and the desired hardness cannot be obtained. Further, the hardness of the hot formed steel sheet member will greatly vary. Furthermore, the delayed fracture characteristic deteriorates. If the heating temperature exceeds the $Ac_3$ point+150° C., the austenite coarsens and the steel sheet member will sometimes deteriorate in toughness.

The heating time of the steel sheet at the time of hot forming is preferably 1 to 10 min. If the heating time is less than 1 min, even if heating, sometimes conversion to a single phase of austenite is insufficient. Further, the carbides are insufficiently dissolved, so even if the γ-grain size becomes fine, the number density of the residual carbides will become greater. If the heating time exceeds 10 min, the austenite will coarsen and the hot formed steel sheet member will deteriorate in hydrogen embrittlement resistance.

The hot forming start temperature is preferably made the $Ar_3$ point or more. If the hot formed start temperature is a temperature of less than the $Ar_3$ point, ferrite transformation starts, so even with forced cooling after that, the structure will not become a martensite single-phase structure in some cases. After hot forming, rapid cooling by a 10° C./s or more cooling speed is preferable, while rapid cooling by a 20° C./s or more speed is more preferable. The upper limit of the cooling speed is not particularly prescribed.

To obtain a high strength hot formed steel sheet member with a single-phase martensite structure with little variation in hardness, it is preferable to cause rapid cooling after hot forming until the surface temperature of the steel sheet becomes 350° C. or less. The cooling end temperature is preferably made 100° C. or less, more preferably is made room temperature.

EXAMPLES

Below, examples will be used to more specifically explain the present invention, but the present invention is not limited to these examples.

Steel having each of the chemical compositions shown in Table 1 was smelted in a test converter and continuously cast by a continuous casting test machine to obtain a width 1000 mm, thickness 250 mm slab. Here, at the conditions shown in Table 2, the heating temperature of the molten steel and amount of casting of molten steel per unit time were adjusted.

The cooling speed of the slab was controlled by changing the amount of water at the secondary cooling spray zone. Further, the center segregation reduction treatment was performed at the end part of solidification using a roll mill to softly reduce the thickness by a gradient of 1 mm/m and discharge the concentrated molten steel of the final solidified part. In some slabs, after that, a soaking treatment was performed under conditions of 1250° C. and 24 h.

TABLE 1

| Steel | Chemical composition (mass %, balance: Fe and unavoidable impurities) | | | | | | | | | | | | | | | | |
|---|---|---|---|---|---|---|---|---|---|---|---|---|---|---|---|---|---|
| type | C | Si | Mn | P | S | sol. Al | N | Cr | Ti | Nb | B | Cu | Ni | Mo | V | Ca | Mn + Cr |
| A | 0.31 | 0.10 | 1.30 | 0.005 | 0.002 | 0.04 | 0.002 | 0.50 | 0.02 | 0.08 | 0.0030 | — | — | — | — | — | 1.8 |
| B | 0.28 | 0.05 | 1.10 | 0.005 | 0.002 | 0.04 | 0.002 | 1.00 | 0.02 | 0.08 | 0.0015 | — | — | — | — | — | 2.1 |
| C | 0.35 | 0.05 | 1.30 | 0.005 | 0.002 | 0.04 | 0.002 | 0.50 | 0.02 | 0.08 | 0.0015 | — | — | — | — | — | 1.8 |
| D | 0.32 | 0.05 | 1.40 | 0.005 | 0.002 | 0.04 | 0.002 | 0.40 | 0.02 | 0.08 | 0.0015 | 0.1 | — | — | — | — | 1.8 |
| E | 0.34 | 0.05 | 1.20 | 0.005 | 0.002 | 0.04 | 0.002 | 0.60 | 0.02 | 0.08 | 0.0015 | — | 0.5 | — | — | — | 1.8 |
| F | 0.31 | 0.05 | 1.30 | 0.005 | 0.002 | 0.04 | 0.002 | 0.70 | 0.02 | 0.08 | 0.0015 | — | — | 0.1 | — | — | 2.0 |
| G | 0.30 | 0.05 | 1.30 | 0.005 | 0.002 | 0.04 | 0.002 | 0.60 | 0.02 | 0.08 | 0.0015 | — | — | — | 0.01 | — | 1.9 |
| H | 0.29 | 0.05 | 1.30 | 0.005 | 0.002 | 0.04 | 0.002 | 1.00 | 0.02 | 0.08 | 0.0015 | — | — | — | — | 0.005 | 2.3 |
| I | 0.31 | 0.13 | 2.40* | 0.005 | 0.002 | 0.04 | 0.002 | 0.20* | 0.02 | 0.08 | 0.0020 | — | — | — | — | — | 2.6 |
| J | 0.21* | 0.10 | 1.30 | 0.005 | 0.002 | 0.04 | 0.002 | 0.10* | 0.02 | 0.08 | 0.0018 | — | — | — | — | — | 1.4* |
| K | 0.35 | 0.10 | 0.40 | 0.005 | 0.002 | 0.04 | 0.002 | 0.30 | 0.02 | 0.08 | 0.0015 | — | — | — | — | — | 0.7* |
| L | 0.32 | 0.10 | 1.30 | 0.005 | 0.002 | 0.04 | 0.002 | 0.40 | 0.02 | —* | 0.0020 | — | — | — | — | — | 1.7 |
| M | 0.30 | 0.10 | 1.30 | 0.005 | 0.003 | 0.04 | 0.002 | 0.30 | 0.02 | 0.08 | 0.0003* | — | — | — | — | — | 1.6 |
| N | 0.31 | 0.10 | 1.40 | 0.005 | 0.008* | 0.04 | 0.002 | 0.40 | 0.02 | 0.08 | 0.0015 | — | — | — | — | — | 1.8 |
| O | 0.32 | 0.50* | 1.00 | 0.005 | 0.002 | 0.04 | 0.002 | 0.60 | 0.02 | 0.08 | 0.0015 | — | — | — | — | — | 1.6 |

*Outside range of present invention

The obtained slab was hot rolled by a hot rolling mill to obtain a thickness 3.0 hot rolled steel sheet. This was coiled up, then the hot rolled steel sheet was pickled and further annealed.

After that, part of the steel sheet was cold rolled by a cold rolling machine to obtain thickness 1.5 mm cold rolled steel sheet. Furthermore, part of the cold rolled steel sheet was annealed at 600° C. for 2 h to obtain steel sheet for hot-forming use.

Figure 2:
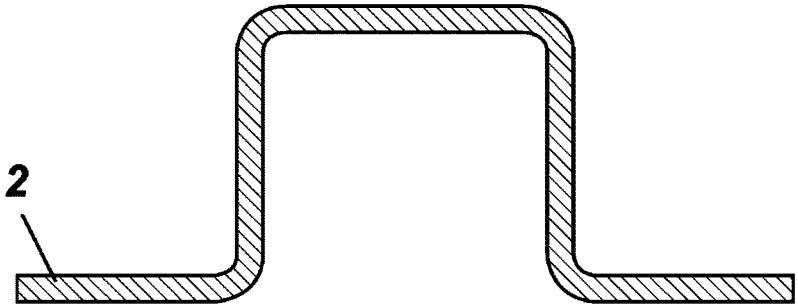
FIG. 2 is a schematic view showing the shape of a shaped article obtained by hot forming in an example.

After that, as shown in FIGS. 1 and 2, a hot press apparatus was used to hot press the above hot-forming use steel sheet 1 by die set (punch 11 and die 12) (forming hat shape) to obtain a hot formed steel sheet member 2. More specifically, the steel sheet was heated inside a heating furnace by 50° C./s until reaching the target temperature, was held at that temperature for various times, then was taken out from the heating furnace and immediately hot pressed by a die set with a cooling system attached so as to form and anneal it simultaneously. The hot formed steel sheet member was evaluated as follows:

Evaluation of Mechanical Characteristics of Hot Formed Steel Sheet Member

The hot formed steel sheet member was measured for tensile strength (TS) by taking a JIS No. 5 tensile test piece from a direction perpendicular to the rolling and performing a tensile test based on JIS Z 2241 (2011).

Evaluation of Cleanliness

Test samples were cut out from five locations of the hot formed steel sheet member. At the positions of thickness ⅛t, ¼t, ½t, ¾t, and ⅞t of each test sample, the point count method was used to investigate the cleanliness. Further, the numerical value of the largest value of cleanliness at the sheet thicknesses (the lowest cleanliness) was made the value of cleanliness of that test sample.

Measurement of Mn Segregation Ratio α

At the center part of sheet thickness of the hot formed steel sheet member, an EPMA was used for line analysis. Three measurement values were selected from the results of analysis in order from the highest one down, then the average value was calculated to find the maximum Mn concentration at the center part of sheet thickness. Further, at a position of ¼ sheet thickness depth from the surface of the hot formed steel sheet member, an EPMA was used to analyze 10 locations. The average value was calculated to find the average Mn concentration at a position of ¼ sheet thickness depth from the surface. Further, the maximum Mn concentration at the center part of sheet thickness was divided by the average Mn concentration at the position of ¼ sheet thickness depth from the surface to find the Mn segregation ratio α.

Measurement of Average Grain Size of Prior γ-Grains

The average grain size of the prior γ-grains in the hot formed steel sheet member was found by counting the number of crystal grains in the measurement field, dividing the area of the measurement field by the number of crystal grains to find the average area of the crystal grains, and calculating the crystal grain size by the circle equivalent diameter. At that time, a grain at the boundary of the field was counted as ½ and the magnification was suitably adjusted to cover 200 or more crystal grains.

Number Density of Residual Carbides

The surface of the hot formed steel sheet member was corroded using a picral solution. A scanning electron microscope was used to examine this enlarged to 2000×. Several fields were examined. At that time, the number of fields in which carbides were present were count and the number of 1 $mm^2$ was calculated.

Evaluation of Delayed Fracture Resistance

The delayed fracture resistance was evaluated by cutting out a test piece of a length 68 mm and width 6 mm having the rolling direction as the longitudinal direction, applying strain to the test piece by four point bending, dipping it into 30° C., pH 1 hydrochloric acid in that state, observing any cracks after the elapse of 100 hours, and converting the lower limit strain at which cracking occurs to a stress value from a stress-strain curve of the test piece.

Variation in Hardness

The following test was performed to evaluate the hardness stability. Hot forming-use steel sheets were heated by a heat treatment simulator by 50° C./s until the target temperatures, then were held in various ways. After that, the sheets were cooled by cooling speeds of about 80° C./s and 10° C./s until room temperature. These samples were tested for Vicker's hardness at positions of ¼ thickness of the cross-section. The hardness was measured based on JIS Z 2244 (2009). The test force was made 9.8N, the hardnesses at five points were measured, the average values of the hardnesses at the five points when the cooling speed was about 80° C./s and 10° C./s were made $HS_{80}$ and $HS_{10}$, and the difference ΔHv was used as an indicator of the hardness stability.

TABLE 2

| | | Slab | | | | | | | | | | | Hot forming | |
|---|---|---|---|---|---|---|---|---|---|---|---|---|---|---|
| | | Molten steel liquidus | Molten steel heating | Amount of casting of molten | center segregation | | Coiling | Annealing after hot rolling | | | Annealing after | Tensile | Heating target | Heating and holding |
| Test no. | Steel type | temp. (° C.) | temp. (° C.) | steel (t/min) | reduction treatment | Soaking treatment | temp. (° C.) | Temp. (° C.) | Time (h) | Cold rolling | cold rolling | strength (MPa) | temp. (° C.) | time (s) |
| 1 | A | 1506 | 1536 | 6.0 | Yes | No | 510 | 650 | 1 | Yes | Yes | 1925 | 880 | 90 |
| 2 | A | 1506 | 1531 | 7.0 | No | 1250° C. × 24 h | 510 | 650 | 1 | Yes | Yes | 1912 | 880 | 90 |
| 3 | B | 1508 | 1543 | 5.1 | Yes | 1250° C. × 24 h | 510 | 650 | 1 | No | No | 1762 | 880 | 90 |
| 4 | B | 1508 | 1506 | 4.5 | No | No | 510 | 650 | 1 | Yes | Yes | 1993 | 880 | 10 |
| 5 | C | 1503 | 1540 | 3.2 | Yes | 1250° C. × 24 h | 620 | 650 | 1 | Yes | No | 2118 | 880 | 90 |
| 6 | C | 1503 | 1540 | 3.2 | No | No | 510 | 650 | 1 | Yes | Yes | 2095 | 880 | 90 |
| 7 | C | 1503 | 1540 | 3.2 | Yes | No | 650 | — | — | Yes | No | 2083 | 880 | 70 |
| 8 | D | 1505 | 1530 | 3.3 | Yes | 1250° C. × 24 h | 510 | 650 | 1 | Yes | Yes | 1976 | 880 | 90 |
| 9 | D | 1505 | 1530 | 3.3 | Yes | 1250° C. × 24 h | 510 | 620 | 10 | Yes | Yes | 1905 | 880 | 90 |
| 10 | D | 1505 | 1530 | 3.3 | Yes | 1250° C. × 24 h | 510 | 650 | 1 | Yes | Yes | 1872 | 1000 | 120 |
| 11 | D | 1505 | 1530 | 3.3 | Yes | 1250° C. × 24 h | 510 | 650 | 1 | Yes | Yes | 1965 | 880 | 70 |
| 12 | E | 1504 | 1521 | 2.8 | Yes | No | 620 | 650 | 1 | Yes | Yes | 2049 | 880 | 90 |
| 13 | F | 1506 | 1532 | 3.4 | Yes | No | 510 | 650 | 1 | Yes | Yes | 1915 | 880 | 90 |
| 14 | G | 1507 | 1537 | 2.5 | Yes | No | 510 | 650 | 1 | Yes | Yes | 1879 | 880 | 90 |
| 15 | H | 1506 | 1546 | 3.0 | Yes | 1250° C. × 24 h | 510 | 650 | 1 | Yes | Yes | 1823 | 880 | 90 |
| 16 | I* | 1500 | 1532 | 3.5 | Yes | No | 510 | 650 | 1 | Yes | Yes | 2070 | 880 | 90 |
| 17 | J* | 1514 | 1567 | 4.3 | Yes | No | 510 | 650 | 1 | Yes | Yes | 1462 | 880 | 90 |
| 18 | K* | 1508 | 1525 | 5.5 | Yes | No | 510 | 650 | 1 | Yes | Yes | 1969 | 880 | 90 |
| 19 | L* | 1505 | 1547 | 3.5 | Yes | No | 510 | 650 | 1 | Yes | Yes | 1971 | 880 | 90 |

TABLE 2-continued

| Test no. | Steel type | Molten steel liquidus temp. (° C.) | Molten steel heating temp. (° C.) | Slab: Amount of casting of molten steel (t/min) | Slab: center segregation reduction treatment | Slab: Soaking treatment | Coiling temp. (° C.) | Annealing after hot rolling: Temp. (° C.) | Annealing after hot rolling: Time (h) | Cold rolling | Annealing after cold rolling | Tensile strength (MPa) | Hot forming: Heating target temp. (° C.) | Hot forming: Heating and holding time (s) |
|---|---|---|---|---|---|---|---|---|---|---|---|---|---|---|
| 20 | M* | 1507 | 1538 | 4.1 | Yes | No | 510 | 650 | 1 | Yes | Yes | 1884 | 880 | 90 |
| 21 | N* | 1505 | 1517 | 2.5 | Yes | No | 510 | 650 | 1 | Yes | Yes | 1950 | 880 | 90 |
| 22 | O* | 1501 | 1517 | 3.5 | Yes | No | 510 | 650 | 1 | Yes | Yes | 1945 | 880 | 90 |

TABLE 3

| Test no. | Variation in hardness: $HS_{80}$ | Variation in hardness: $HS_{10}$ | Variation in hardness: ΔHv | Prior γ-grain size (μm) | Segregation ratio α | Cleanliness (%) | Density of residual carbides (/mm$^2$) | Delayed fracture breaking stress (MPa) | |
|---|---|---|---|---|---|---|---|---|---|
| 1 | 553 | 482 | 71 | 6 | 1.1 | 0.02 | $1.25 \times 10^3$ | 1460 | Inv. ex. |
| 2 | 542 | 456 | 86 | 7 | 1.2 | 0.09* | $1.752 \times 10^3$ | 1210 | Comp. ex. |
| 3 | 502 | 458 | 44 | 6 | 0.8 | 0.02 | $2.253 \times 10^3$ | 1620 | Inv. ex. |
| 4 | 562 | 482 | 80 | 3 | 1.9* | 0.09* | $7.12 \times 10^3$* | 1195 | Comp. ex. |
| 5 | 583 | 507 | 76 | 7 | 1.1 | 0.02 | $2.789 \times 10^3$ | 1310 | Inv. ex. |
| 6 | 581 | 503 | 78 | 7 | 1.8* | 0.02 | $3.2 \times 10^3$ | 1180 | Comp. ex. |
| 7 | 578 | 496 | 82 | 6 | 1.2 | 0.02 | $4.7 \times 10^3$* | 1190 | Comp. ex. |
| 8 | 551 | 472 | 79 | 6 | 1.1 | 0.02 | $3.437 \times 10^3$ | 1490 | Inv. ex. |
| 9 | 535 | 432 | 103 | 4 | 1.1 | 0.02 | $5.12 \times 10^3$* | 1100 | Comp. ex. |
| 10 | 545 | 470 | 75 | 20* | 1.2 | 0.02 | $0.05 \times 10^3$ | 1160 | Comp. ex. |
| 11 | 548 | 462 | 86 | 5 | 1.1 | 0.02 | $3.78 \times 10^3$ | 1340 | Inv. ex. |
| 12 | 567 | 563 | 5 | 6 | 1.1 | 0.02 | $2.019 \times 10^3$ | 1300 | Inv. ex. |
| 13 | 537 | 500 | 37 | 6 | 1.1 | 0.02 | $2.293 \times 10^3$ | 1460 | Inv. ex. |
| 14 | 529 | 523 | 5 | 6 | 1.1 | 0.02 | $2.058 \times 10^3$ | 1520 | Inv. ex. |
| 15 | 516 | 511 | 5 | 6 | 0.7 | 0.02 | $2.251 \times 10^3$ | 1550 | Inv. ex. |
| 16 | 552 | 515 | 37 | 6 | 1.8* | 0.02 | $3.015 \times 10^3$ | 1050 | Comp. ex. |
| 17 | 441 | 340 | 101 | 6 | 1.1 | 0.02 | $3.248 \times 10^3$ | 2260 | Comp. ex. |
| 18 | 557 | 146 | 411 | 6 | 1.1 | 0.02 | $3.75 \times 10^3$ | 1750 | Comp. ex. |
| 19 | 549 | 461 | 88 | 13* | 1.1 | 0.02 | $3.015 \times 10^3$ | 1150 | Comp. ex. |
| 20 | 530 | 229 | 301 | 6 | 1.1 | 0.02 | $2.75 \times 10^3$ | 1230 | Comp. ex. |
| 21 | 545 | 474 | 71 | 6 | 1.1 | 0.09* | $2.514 \times 10^3$ | 1050 | Comp. ex. |
| 22 | 544 | 439 | 105 | 6 | 1.1 | 0.02 | $2.3 \times 10^3$ | 1070 | Comp. ex. |

*Outside range of present invention

Samples with a delayed fracture resistance and hardness stability of respectively a delayed fracture cracking stress of 1250 MPa or more and a ΔHv of 100 or less were judged as good.

Table 3 Shows the Results.

Test No. 2 had a composition of the steel satisfying the requirements of the present invention, but had a large amount of casting of molten steel per unit time, so the result was the value of the cleanliness exceeded 0.08% and the delayed fracture strength was inferior.

Test No. 4 had a composition of steel satisfying the requirements of the present invention, but had a low molten steel heating temperature, so the value of the cleanliness exceeded 0.08%. Further, no center segregation treatment and soaking treatment were performed, so the Mn segregation ratio exceeded 1.6. Furthermore, the heating and holding time at the time of hot forming was short, so the residual carbide density became high. As a result, the result was the delayed fracture strength was inferior.

Test No. 6 did not include center segregation treatment and soaking treatment, so the result was that the Mn segregation ratio exceeded 1.6 and the delayed fracture strength was inferior.

Test No. 7 did not include annealing after hot rolling, so the result was that the dissolution of the carbides was delayed and the delayed fracture strength was inferior.

Test No. 9 had a long annealing time after hot rolling, so the result was that the dissolution of the carbides was insufficient and the number density of the residual carbides became high, so the delayed fracture strength was inferior.

Test No. 10 had a high heating temperature at the time of hot forming, so the result was the austenite grains coarsened and the fracture strength was inferior.

Test No. 16 had an Mn content exceeding the prescribed upper limit value, so the result was that the Mn segregation ratio exceeded 1.6 and the delayed fracture strength was inferior.

Test Nos. 17 and 18 were low in total contents of Mn and Cr, so the result was that the hardness stability was inferior.

Test No. 19 did not contain Nb, so the result was that the prior γ-grain size become larger and the delayed fracture strength was inferior.

Test No. 20 was low in B content, so the result was that the hardness stability was inferior.

Test No. 21 had an S content exceeding the prescribed upper limit value, so the result was that the value of the cleanliness exceeded 0.08% and the delayed fracture strength was inferior.

Test No. 22 had an Si content exceeding the prescribed upper limit value, so the result was that the $A_3$ point rose, the structure did not become a martensite single-phase structure after hot forming, and the hardness stability and delayed fracture strength were inferior.

Test Nos. 1, 3, 5, 8, and 11 to 15 satisfying the requirements of the present invention were excellent in both hardness stability and delayed fracture resistance in the results.

INDUSTRIAL APPLICABILITY

According to the present invention, it is possible to obtain a high strength hot formed steel sheet member having a 1.7 GPa or more tensile strength and realizing both hardness stability and delayed fracture resistance. The high strength hot formed steel sheet member of the present invention is particularly suitable for use as impact resistant parts of an automobile.

REFERENCE SIGNS LIST

1. hot forming-use steel sheet

2. hot formed steel sheet member

11. punch

12. die

The invention claimed is:

1. A high-strength hot-formed steel sheet member having a chemical composition comprising, by mass %, C: 0.25 to 0.40%, Si: 0.005 to 0.14%, Mn: 1.50% or less, P: 0.02% or less, S: 0.005% or less, sol. Al: 0.0002 to 1.0%, N: 0.01% or less, Cr: 0.25 to 3.00%, Ti: 0.01 to 0.05%, Nb: 0.01 to 0.50%, B: 0.001 to 0.01%, and a balance of Fe and unavoidable impurities;

a total of content of Mn and content of Cr of 1.5 to 3.5%;

an Mn segregation ratio $\alpha$ represented by the following formula (i) of 1.6 or less;

a value of cleanliness of steel prescribed by JIS G 0555 (2003) of 0.08% or less;

having an average grain size of prior $\gamma$-grains of 10 μm or less; and a number density of residual carbides present of $4\times10^3/mm^2$ or less:

$$\alpha=[\text{Maximum Mn concentration at center part in sheet thickness(mass \%)}]/[\text{Average Mn concentration at position of 1/4 sheet thickness depth from surface(mass \%)}] \quad \text{(i)}.$$

2. The high-strength hot-formed steel sheet member according to claim 1 wherein said chemical composition further includes, by mass %, one or more elements selected from Ni: 0 to 3.0%, Cu: 0 to 1.0%, Mo: 0 to 2.0%, V: 0 to 0.1%, and Ca: 0 to 0.01%.

3. The high-strength hot-formed steel sheet member according to claim 2 having a plating layer at the surface of said steel sheet.

4. The high-strength hot-formed steel sheet member according to claim 2 wherein said steel sheet member has a tensile strength of 1.7 GPa or more.

5. The high-strength hot-formed steel sheet member according to claim 1 having a plating layer at the surface of said steel sheet.

6. The high-strength hot-formed steel sheet member according to claim 5 wherein said steel sheet member has a tensile strength of 1.7 GPa or more.

7. The high-strength hot-formed steel sheet member according to claim 1 wherein said steel sheet member has a tensile strength of 1.7 GPa or more.

* * * * *